United States Patent [19]

Herout et al.

[11] 4,209,383

[45] Jun. 24, 1980

[54] LOW BENZENE CONTENT GASOLINE PRODUCING PROCESS

[75] Inventors: Richard C. Herout, Palatine; Kenneth D. Uitti, Bensenville, both of Ill.

[73] Assignee: UOP Inc., Des Plaines, Ill.

[21] Appl. No.: 961,320

[22] Filed: Nov. 16, 1978

Related U.S. Application Data

[63] Continuation-in-part of Ser. No. 848,058, Nov. 3, 1977, Pat. No. 4,140,622.

[51] Int. Cl.[2] ..... C07C 5/32; C10G 39/00

[52] U.S. Cl. ..... 208/93; 585/448

[58] Field of Search ..... 208/93; 260/671 R, 671 P; 585/448

[56] References Cited

U.S. PATENT DOCUMENTS

| | | | |
|---|---|---|---|
| 2,335,596 | 11/1943 | Marschner | 260/671 R |
| 2,730,557 | 1/1956 | Max et al. | 260/671 R |
| 2,955,143 | 10/1960 | Bloch | 260/671 R |
| 4,000,206 | 12/1976 | Drehman | 208/63 |

*Primary Examiner*—Herbert Levine

*Attorney, Agent, or Firm*—James R. Hoatson, Jr.; John F. Spears, Jr.; William H. Page, II

[57] ABSTRACT

A process for the production of a gasoline having a low benzene content. A catalytic reformate and a stripped liquid produced in the gas concentration unit of an FCC unit are fractionated in a dehexanizer to concentrate the benzene and $C_3$–$C_4$ olefins these two streams contain into a single stream. This stream is passed into an alkylation zone wherein at least some of the benzene is alkylated with the olefins. The alkylation zone effluent is stripped and recombined with $C_7$-plus dehexanizer bottoms stream to form a gasoline product stream.

8 Claims, 1 Drawing Figure

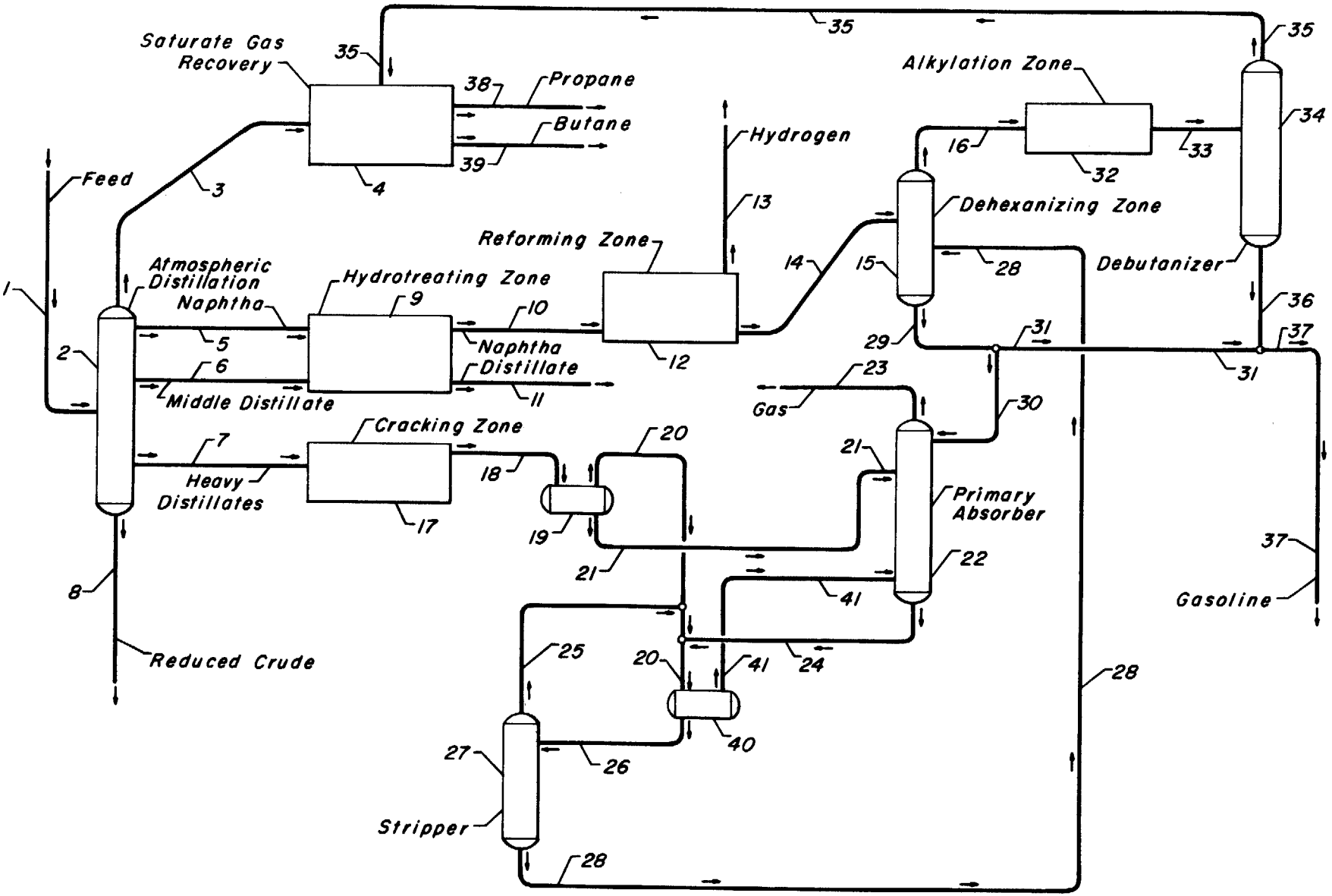
Alkylation Zone
Debutanizer
Dehexanizing Zone
Primary Absorber
Gasoline
Hydrogen
Reforming Zone
Hydrotreating Zone
Cracking Zone
Naphtha Distillate
Middle Distillate
Heavy Distillates
Atmospheric Distillation Naphtha
Reduced Crude
Feed
Gas
Propane
Butane
Saturate Gas Recovery
Stripper

LOW BENZENE CONTENT GASOLINE PRODUCING PROCESS

CROSS-REFERENCE TO RELATED APPLICATION

This application is a continuation-in-part of our prior copending application Ser. No. 848,058 filed on Nov. 3, 1977 and issued as U.S. Pat. No. 4,140,622 on Feb. 20, 1979. The content and teaching of our prior application is incorporated in this application by reference.

FIELD OF THE INVENTION

The invention relates to a petroleum refining process for the production of a gasoline product. The invention more specifically relates to a process for producing a gasoline containing a low amount of benzene. The process includes such operations as the catalytic reforming of a naphtha, catalytic cracking of a heavier petroluem distillate, fractionation of various hydrocarbon streams, and the alkylation of benzene in the reformate with light olefins produced in a catalytic cracking zone.

PRIOR ART

Large amounts of benzene are present in several of the liquid streams used in petroluem refineries as gasoline blending stocks. These liquid streams include reformates and the gasoline boiling range hydrocarbons produced in a fluidized catalytic cracking (FCC) unit. However, in some instances, a portion of this benzene has been removed, as by liquid-liquid extraction, to be used as a petrochemical feedstock and for other purposes. The great majority of benzene present in gasoline precursor streams has been allowed to remain in these streams since it is very abundant and has a relatively high octane number.

The use of benzene as an alkylation zone feed material is described in U.S. Pat. No. 2,730,557 (Cl. 260-671) issued to M. Nicolass et al. This reference presents a process wherein benzene derived from a reformate is reacted with an olefin produced in a catalytic cracking unit. This process is directed to the production of dialkyl benzenes and especially paradialkyl benzenes for use as high octane motor fuel blending components. U.S. Pat. No. 2,335,596 (Cl. 260-671) issued to H. S. Bloch also presents a hydrocarbon conversion process wherein aromatic hydrocarbons produced in a reforming zone are alkylated with light olefins.

The alkylation of benzene is widely practiced commercially. For instance, the alkylation of benzene with propylene to form cumene is described in U.S. Pat. Nos. 3,132,109 (Cl. 252-435); 3,293,315 (Cl. 260-671); 3,499,826 (Cl. 208-27); 3,510,534; 3,520,945 and 4,008,290 (Cl. 260-672). These references also describe solid phosphoric acid (SPA) catalysts. Another catalyst system utilizes boron trifluoride to effect the alkylation of benzene with ethylene or propylene. This alkylation process is described in U.S. Pat. Nos. 2,995,611 (Cl. 260-671); 3,126,421; 3,238,268 and 3,894,090. A large number of other catalyst systems are known. Examples are found in U.S. Pat. Nos. 2,887,520 and 3,336,410.

The contacting of gasolines produced by catalytic cracking with an SPA catalyst was performed in a process referred to as polytreating. This process is described in an article which appears at page 1045 of Vol. 38, No. 10 of *Industrial and Engineering Chemistry* published in October, 1946. The conditions employed in the process included a temperature from about 400° F. to 560° F. and a pressure in excess of 400 psig. The objective of the invention was to lower the concentration of various olefinic constituents which, by virtue of their low lead susceptibility, were considered less desirable. The article specifies aromatic hydrocarbons of the gasoline undergo virtually no change during the polytreating reactions and this is described as highly desirable. Among the reactions listed as occurring during the process are the polymerization of olefins, the cyclization of higher olefins to naphthenes and the hydrogenation of olefins present in the original gasoline by hydrogen produced in other reactions.

BRIEF SUMMARY OF THE INVENTION

One embodiment of the invention may be characterized as providing a process for the production of a gasoline having a low benzene concentration which comprises the steps of fractionating a crude oil feed stream into a light first distillate and a heavier second distillate; passing the first distillate through hydrotreating and catalytic reforming zones; passing a liquid-phase reforming zone effluent stream comprising benzene and $C_7$ to $C_9$ hydrocarbons in a first fractionation zone and producing a net overhead stream comprising benzene and a net bottoms stream comprising $C_7$ hydrocarbons; passing the second distillate into a fluidized catalytic cracking zone which includes a main fractionation column and producing a main column net overhead vapor stream and a main column net overhead liquid stream which are passed into a gas concentration unit comprising an absorber and a second fractionation column; passing a net bottoms stream comprising $C_3$ olefins, benzene and $C_7$ hydrocarbons and withdrawn from the second fractionation column into the first fractionation column; passing a first portion of the net bottoms stream of the first fractionation column into the gas concentration unit absorber as a lean oil stream; passing the net overhead stream of the first fractionation column through an alkylation zone and producing $C_9$ alkylaromatic hydrocarbons by the reaction of benzene and $C_3$ olefins; passing the alkylation zone effluent stream into a third fractionation column and producing a net bottoms stream comprising $C_9$ alkylaromatic hydrocarbons; and combining the net bottoms stream of the third fractionation column with a second portion of the net bottoms stream of the first fractionation column and thereby forming a gasoline boiling range product stream.

BRIEF DESCRIPTION OF THE DRAWING

The drawing is a flow diagram illustrating the invention process.

DESCRIPTION OF THE DRAWING

A crude oil feed stream carried by line 1 enters an atmospheric distillation column 2 and is separated into several distillate fractions having different boiling point ranges. The light hydrocarbons and any gases dissolved in the feed stream are removed through line 3 and passed into a saturate gas recovery zone 4. The light normally liquid hydrocarbons are removed as a naphtha stream through line 5 and the somewhat heavier middle distillates are removed through line 6. A heavy distillate such as a gas oil fraction is removed through line 7 and passed into a fluidized catalytic cracking zone 17. The remaining reduced crude fraction is removed in line 8 and may be passed into suitable residual oil processing zones including vacuum distillation, coking, and hydrocracking units.

The naphtha fraction and the middle distillate fraction are both passed into a hydrotreating zone 9 which will normally comprise a separate hydrotreating unit for each fraction. The resulting hydrorefined distillate is removed from the process in line 11 and may be a kerosene or other normally produced product. A hydrotreated naphtha fraction is passed through line 10 to a reforming zone 12 wherein it is catalytically reformed to produce a reformate having a higher octane number than the hydrotreated naphtha and to generate hydrogen removed in line 13. The reformate is passed into a dehexanizing zone 15 through line 14.

The heavy distillate fraction carried by line 7 is passed into a fluidized catalytic cracking zone which includes a so-called main fractionation column. The overhead vapor stream of the main fractionation column is removed in line 18 and cooled in an overhead condenser not shown before being passed into the overhead receiver 19 of the main column. The condensate which is collected in the overhead receiver 19 is passed through line 21 into an intermediate point of a primary absorber 22. The uncondensed gases which were originally part of the main column overhead vapor stream are removed from the overhead receiver in line 20 and pressurized by a compressor not shown. The resultant high pressure gas is cooled to effect a second partial condensation and is then passed into the high pressure receiver 40.

The high pressure receiver 40 also acts as a phase separation vessel wherein the various entering streams are separated into a single vapor phase and a single hydrocarbon liquid phase. The vapor phase material is removed from the high pressure receiver 40 in line 41 and passed into a lower portion of the primary absorber 22. This vapor stream rises through the primary absorber countercurrent to the entering liquid stream carried by line 21 and to a lean liquid stream carried by line 30. A very sizable percentage of the $C_2+$ hydrocarbons contained in the vapor stream are absorbed into these liquid streams and are removed from the primary absorber as a rich liquid stream in line 24. The net gas which remains after the absorption operation is removed in line 23 and may be passed into a second or sponge absorber or into other separatory facilities or utilized as fuel.

The liquid phase material which is collected in the high pressure receiver 40 is removed in line 26 and passed into a deethanizer 27 which functions as the stripper normally associated with the primary absorber 22. The stripping action which occurs in the deethanizer produces an overhead vapor stream carried by line 25 which comprises ethane. This overhead vapor stream is passed into the high pressure receiver 40 in admixture with the rich liquid stream from the primary absorber and the partially condensed vapors removed from the overhead receiver 19. Column 27 may be operated as a depropanizer if desired.

A net $C_3+$ bottom stream comprising propane, propylene, butane, butylenes and benzene is removed from the deethanizer in line 28 and passed into the dehexanizing zone 15. This zone may comprise two separate columns, with each receiving one of the input streams. The dehexanizing zone functions as the stabilizer which is normally associated with a reforming zone. It also functions to prevent the passage of $C_7+$ hydrocarbons into the alkylation zone 32. The dehexanizing zone is operated under conditions effective to produce an overhead vapor stream carried by line 16 which comprises benzene and substantially all of the lower-boiling hydrocarbons which are passed into the dehexanizing zone. The material in line 16 is therefore an admixture of benzene, $C_3+$ or $C_4+$ paraffins and $C_3+$ or $C_4+$ olefins. If two columns are used, the overhead and bottoms streams of this zone are formed by admixture of the respective overhead and bottoms streams of the individual columns. The remaining $C_7+$ hydrocarbons are removed from the dehexanizing zone in line 29 as a bottoms stream. A first portion of this stream is passed into the primary absorber 22 through line 30 as a lean liquid utilized in the absorber. The remaining second portion of the $C_7+$ material is passed through line 31.

The hydrocarbons carried by line 16 are passed into an alkylation zone 32 wherein they are contacted with an alkylation catalyst maintained at alkylation-promoting conditions effective to cause the alkylation of a sizable portion of the entering benzene with the entering light olefins. This effects production of an alkylation zone effluent stream carried by line 33 comprising alkylated aromatic hydrocarbons and relatively unreactive paraffins such as propane and butane. The alkylation zone effluent stream is passed into a debutanizer 34 wherein the remaining $C_4$-hydrocarbons are separated into a net overhead vapor stream removed in line 35. This net overhead vapor stream is passed into the saturate gas recovery zone 4 or, if desired, to other separatory facilities.

The saturate gas recovery zone will normally comprise fractionation columns arranged in a manner which will produce the desired products from the entering gas streams. These products may be relatively pure streams of propane and butane such as those removed in lines 38 and 39 respectively or an LPG gas mixture. Streams of lighter gases may be removed by means not shown. The net bottom stream removed from the debutanizer 34 comprises $C_5+$ hydrocarbons suitable for use as a gasoline. This net bottoms stream is blended with the remaining portion of dehexanizing zone bottoms carried by line 31 to form a gasoline product stream removed from the process in line 37.

The drawing illustrates the preferred embodiment of the invention. However, this representation of the preferred embodiment is not intended to preclude from the scope of the inventive concept those other embodiments set out herein or which are the result of reasonable and normal modification of these embodiments. For clarity in describing the inventive concept, various subsystems and apparatus normally associated with operation of the process have not been shown. These include flow pressure control valves, pmps, temperature, pressure and flow control systems, reactor and fractionator internals, crude column strippers, reboilers, overhead condensing systems, etc., which may be of customary design.

DETAILED DESCRIPTION

Benzene is present in the gasoline boiling range effluent streams of several petroleum refining processes. These processes include catalytic reforming, hydrotreating, coking, pyrolysis and fluidized catalytic cracking. Some of the benzene in gasoline boiling range streams is recovered and purified, as by liquid-liquid extraction and fractionation, for use as a petrochemical product or feedstock. However, the amount of benzene present in the total of the streams used for gasoline production far exceeds the amount required to satisfy the market demand for benzene. Most of the benzene in gasoline boiling range streams is therefore allowed to remain in these streams and is eventually used as a component of a gasoline product stream.

Benzene is now coming under close scrutiny as a possible carcinogen or leukemogen. Its presence in gasoline therefore presents the possibility that service station operators, motorists and others are being exposed to harmful benzene concentrations on a regularly recurring basis.

Benzene may be eliminated from gasoline precursor streams in the same manner it is now partially removed for benzene production. For instance, reformates may be fractionated to yield a $C_6$ to $C_8$ cut which is then fed to a liquid-liquid extraction zone and contacted with a solvent selective for aromatic hydrocarbons. The resultant extract stream is separated to yield an aromatic hydrocarbon product stream from which the benzene may be separated by fractionation. A suitable aromatic hydrocarbon extraction process is described in U.S. Pat. Nos. 3,492,222; 3,642,614 and 3,652,452. If the gasoline precursor stream is derived from a catalytic cracking process, it will normally be necessary to hydrotreat the precrusor stream prior to charging it into the liquid-liquid extraction zone. The benzene obtained in this manner may be alkylated to yield styrene, cumene or a long chain alkylate used to manufacture detergents. This method of reducing the benzene content of a gasoline product stream has the disadvantage of increasing the complexity of the refining process by introducing a multitude of new operations. It also increases the cost of producing the gasoline and may reduce the octane number of the gasoline.

It is therefore an objective of the present invention to provide a relatively low cost process for producing a gasoline product stream having a low benzene content. It is another objective to provide an economical process to produce a low benzene-gasoline (LBG) which has a minimal adverse effect on the octane number and other properties of the product gasoline. It is a further objective of the invention to provide a low cost method of reducing the benzene content of modern refineries which employ a fluidized catalytic cracking unit and a catalytic reforming unit.

The subject process utilizes several conventional refining steps including fractionation, catalytic reforming, hydrotreating, fluidized catalytic cracking and alkylation. The basic operation of most of these steps will remain unchanged, but there will be significant changes in the fractionation steps normally associated with specific catalytic operations. The invention also presents a unique integrated gasoline production process.

In the subject process, a gasoline boiling range product is produced from two or more gasoline precursor streams. As used herein, the term "gasoline precursor stream" is intended to refer to a benzene-containing stream comprising a mixture of aromatic and paraffin hydrocarbons having boiling points between about 90° F. and 410° F. and which is to be used to produce gasoline. Gasolines are often produced by blending together several different hydrocarbon streams. Some of these streams do not contain benzene, and therefore do not require treatment by the subject invention. For instance, a benzene-free branched chain paraffinic hydrocarbon stream, such as that produced by the HF-catalyzed alkylation of isobutane, may be used in blending the final gasoline product stream. However, this blending is preferably done downstream of the subject process in order to avoid the unnecessary treating of this material. Likewise, any addition of butane or other light hydrocarbons to adjust the volatility of the product gasoline is also preferably done downstream of the subject benzene removal process.

A gasoline precursor or feed stream will normally contain about 0.5 to 6.5 or higher mole percent benzene. It may also contain various $C_7$ to $C_{10}$ aromatic hydrocarbons including about 1.0 mole percent toluene and often at least 10 mole percent of $C_8$ to $C_{10}$ aromatic hydrocarbons. The total concentration of all aromatic hydrocarbons in the gasoline precursor stream may be above 25 mole percent. The gasoline precursor stream will also normally contain some $C_4$ to $C_6$ paraffinic hydrocarbons. These may include butane, isopentane, isohexane and n-hexane and will normally be present at a concentration above 5.0 mole percent. $C_7$ to $C_9$ paraffinic hydrocarbons such as isoheptane and iso-octane are also present in many gasoline precursor streams. The concentration of these paraffins will normally be above 2.0 mole percent and may be above 5.0 or 15.0 mole percent. The exact composition of the gasoline precursor stream will depend on its source. Two typical gasoline precursor streams are the bottoms product of the stripper column used in FCC gas concentration units and a stabilized reformate which contains $C_6$ to $C_9$ aromatic hydrocarbons.

Crude oils are typically subjected to an initial separation in a crude oil fractionation column operated at a slight positive pressure. This produces several hydrocarbon streams including a bottoms or reduced crude fraction which may be passed into a subatmospheric pressure or vacuum fractionation column. The reduced crude may also be subjected to such processing steps as propane deasphalting, hydrocracking, etc. One of the distillates produced by the crude column will be a naphtha or straightrun gasoline. This gasoline boiling range stream will normally be hydrotreated to remove objectionable sulfur and nitrogen compounds and then passed into a catalytic reforming unit wherein the octane number of this stream will be increased. Passage of a naphtha through a reforming zone also results in an increase in the concentration of aromatic hydrocarbons including benzene in the naphtha stream.

In a reforming zone, the naphtha feed stream is vaporized and contacted with a bed of solid reforming catalyst comprising a catalytically effective amount of a platinum group metal. The catalyst bed effluent stream is then cooled, partially condensed, and passed into a vapor-liquid separator. A hydrogen-rich vapor stream is removed from this separator, with a portion being recycled through the catalyst bed in admixture with the naphtha feed stream. The liquid stream withdrawn from the phase separator is referred to herein as a reformate stream. This stream is customarily stabilized and is often debutanized to form a $C_5$-plus gasoline blending stock in a fractionation column referred to as the reforming zone stabilizer column.

The atmospheric distillation of the crude oil will normally also produce two or more heavier distillate streams. Much of the middle distillates produced in this manner are subsequently hydrotreated to produce such fuels as kerosine or jet fuel. The heavier distillates, such as an atmospheric gas oil fraction may be passed into a hydrocracking zone or a fluidized catalytic cracking (FCC) zone. The reduced crude removed from the bottom of the crude column is often passed into a vacuum column, with the resultant vacuum gas oils being charged to an FCC unit. The action of the FCC unit on the distillate will result in the production of a lighter distillate, typically a gasoline boiling range stock, and a mixture of various lighter hydrocarbons including $C_2$ to $C_5$ olefins and paraffins. Heavier distillates may also be produced in the FCC unit. A distillation column referred to in the refining arts as a "main column" is normally associated with the FCC unit and operates as an integral part of the FCC unit. The cooled vaporous effluent stream of the reaction zone of the FCC unit is charged to a lower portion of this column. The main column separates this effluent stream into a heavy liquid phase slurry oil containing catalyst particles and an overhead stream containing the lighter products of the cracking reaction. The main column overhead stream is then subjected to the customary partial condensation and passed into an overhead receiver, from which net vapor and liquid-phase streams are withdrawn.

The net vapor and liquid-phase streams withdrawn from the main column overhead receiver are passed into what is referred to in the art as a "gas concentration unit". A gas concentration unit will normally comprise at least one absorber column, a high pressure receiver, and at least one stripping column. The net vapor stream removed from the main column overhead system is pressurized and passed into the high pressure receiver wherein it is admixed with vapors from other sources. A vapor stream containing $C_1$ to $C_5$ hydrocarbons is removed from the high pressure receiver and passed into the bottom of the absorber column which is often referred to as the primary absorber. It is therein contacted with a downward flowing liquid-phase lean oil passed into an upper portion of the absorber. The absorber is operated at conditions which effect the transfer of a very high percentage of all the $C_2$ to $C_5$-plus hydrocarbons in the vapor stream to the lean oil stream. The remaining portion of the vapor stream is removed at the top of the absorber column and may be passed into a secondary absorber to recover an additional amount of light hydrocarbons. The remaining vapor stream may then be used as fuel. The rich oil from the bottom of the primary absorber is normally passed into the high pressure receiver.

A liquid stream is withdrawn from the bottom of the high pressure receiver and passed into the stripping column. Typically, the stripping column is operated at conditions effective to remove substantially all $C_2$ or $C_3$ and lighter hydrocarbons from the entering high pressure receiver liquid. These light hydrocarbons are removed as the stripper net overhead vapor stream and passed into the high pressure receiver. The bottoms stream of the stripping column is often passed into a depropanizer or a debutanizer. It may also be passed through a depropanizer and a debutanizer in series. The bottoms stream of the final stripping column is normally the $C_5$-plus gasoline precursor stream of the FCC unit. A portion of this gasoline stream may be passed into the upper portion of the absorber as a lean oil. Gas concentration units may have flow schemes which depart from this description to more closely correspond to the particular needs or process flow of specific refineries. For example, a slightly different flow scheme is shown at page 25 of Volume 15 of Kirk-Othmer *Encyclopedia of Chemical Technology*, 2nd Ed., Interscience Publishers, 1969.

In the subject invention, the operation of the reforming and gas concentration zones differs in several ways from the customary operational modes which have just been described. One difference is that the reformate liquid stream removed from the phase separator of the reforming zone is passed into a fractionation column which concentrates substantially all of the benzene in the reformate into a net overhead stream. Substantially all of the heavier hydrocarbons such as $C_7$ or $C_9$ aromatics are removed in the bottoms stream of this column. That is, the reformate is passed into a dehexanizing zone operated to remove benzene overhead instead of the customary debutanizer or depentanizer. The resultant net overhead stream will also comprise those lighter hydrocarbons, such as propane, butane and pentane, present in the liquid-phase reformate stream removed from the phase separator. It is not considered beneficial for the overhead stream of the dehexanizing zone to contain any significant concentration of $C_7$ hydrocarbons. This is to limit the production of high boiling alkylation products.

The operation of the gas concentration unit is also modified from the typical operations set out above. A first difference is the removal of light olefins from the stripping column as part of the net bottoms stream. These olefins may have four, three or even two carbon atoms per molecule, and the presence of such light hydrocarbons in the stripping column bottoms stream represents a significant departure from the prior art.

Preferably, the bottoms stream of the stripping column of the gas concentration unit is passed into an intermediate point of the same dehexanizing column which receives the reformate from the reforming zone phase separator. That is, the stripping columns bottoms stream is preferably passed into the reformate dehexanizer column. The light olefins and benzene present in the stripping column bottoms will therefore become part of the net overhead stream of this dehexanizer column. In a different embodiment of the invention, the dehexanizing zone comprises two fractionation columns which are operated as dehexanizers. In this embodiment, the stripping columns bottoms stream is passed into a third fractionation column which is operated under conditions effective to concentrate essentially all of the entering benzene and lower boiling compounds into an overhead stream. The remaining $C_7$-plus hydrocarbons are removed as a bottoms stream which is preferably used as a gasoline blending stock. The overhead stream of this third column is then admixed with the reformate dehexanizer net overhead stream.

The practice of the subject invention also preferably differs from the previously described customary operations by the passage of a portion of the reformate dehexanizer bottoms stream into the absorber of the gas concentration unit. This liquid-phase stream will contain only $C_7$ or heavier hydrocarbons and is introduced at the top of the absorber as a lean oil. The combined bottoms stream of the dehexanizing zone, formed by admixing the bottoms stream of both dehexanizer columns, may also be used as this lean oil stream. The net overhead liquid of the FCC main fractionation column is introduced into the absorber at a lower intermediate point.

According to the inventive concept, the overhead stream of the dehexanizing zone is passed into an alkylation zone. If a dehexanizing zone containing two dehexanizer columns is employed, the two overhead streams produced in this manner are admixed prior to their passage into the alkylation zone. In either case, substantially all of the benzene and $C_4$ olefins present in both the reformate liquid stream and the two net overhead streams of the FCC unit main column are eventually passed into the alkylation zone. Depending on the operation of the stripping column, lighter olefins may also be passed into the alkylation zone in this manner to the extent that substantially all of the ethylene and propylene recovered in the absorber may ultimately be charged to the alkylation zone. As used herein, the term "substantially all" is intended to indicate at least 90 mole percent of the specified hydrocarbon or other chemical.

The alkylation zone is operated at conditions which cause at least some of the entering benzene to react with the light olefins. The benzene is thereby consumed and $C_8$ to $C_{10}$ alkylaromatic hydrocarbons, such as isopropylbenzene or ethylbenzene, are produced. The effluent stream of the alkylation zone is passed into a fractionation zone which is preferably operated as a debutanizer. The $C_2$ to $C_4$ olefins which were not consumed in the alkylation reaction and any other light hydrocarbons, such as propane, which are present in the alkylation zone effluent stream are removed as the net overhead stream of this fractionation zone. This overhead stream may then be sent to the gas recovery zone or to other separation facilities. The net bottoms stream of this fractionation zone will contain the remaining benzene and the products of the alkylation reaction. It is mixed with the available portion of the dehexanizing zone bottoms stream to form a gasoline boiling range product stream having a reduced benzene content.

One embodiment of the invention may be characterized as a process for the production of gasoline which comprises the steps of fractionating a crude oil feed stream into a light first hydrocarbon distillate stream which comprises $C_8$ hydrocarbons and a heavier second hydrocarbon distillate stream produced in a column operated at a subatmospheric pressure; hydrotreating the first hydrocarbon distillate stream; passing the first hydrocarbon distillate stream into a catalytic reforming zone operated at reforming conditions and effecting the production of a liquid-phase reforming zone effluent stream comprising benzene and $C_7$ to $C_9$ hydrocarbons; passing the reforming zone effluent stream into a first fractionation column operated at conditions effective to produce a net overhead stream comprising benzene and a net bottoms stream comprising $C_7$ to $C_9$ hydrocarbons; passing the second hydrocarbon distillate stream into a fluidized catalytic cracking zone which comprises a reaction zone and a main fractionation column and effecting the production of a main column net overhead vapor stream and a main column net overhead liquid stream which are passed into a gas concentration unit comprising an absorber and a second fractionation column; removing a net bottoms stream comprising $C_3$ olefins, $C_3$ paraffins, benzene and $C_7$ to $C_9$ hydrocarbons from the second fractionation column; passing the net bottoms stream of the second fractionation column into the first fractionation column; passing a first portion of the net bottoms stream of the first fractionation column into the absorber of the gas concentration unit as a lean oil stream; passing the net overhead stream of the first fractionation column into an alkylation zone maintained at alkylation-promoting conditions and effecting the alkylation of benzene and the production of an alkylation zone effluent stream comprising $C_9$ alkylaromatic hydrocarbons and $C_3$ paraffins; passing the alkylation zone effluent stream into a third fractionation column operated at conditions effective to produce a net overhead stream comprising $C_3$ paraffins and a net bottoms stream comprising $C_9$ alkylaromatic hydrocarbons; and combining the net bottoms stream of the third fractionation column with a second portion of the net bottoms stream of the first fractionation column and thereby forming a gasoline boiling range product stream.

The stream charged to the alkylation zone is brought into intimate contact with an alkylation catalyst maintained at benzene alkylation-promoting conditions. A homogeneous catalyst system may be employed if desired. These include hydrofluoric acid systems, sulfuric acid systems and various Friedel-Crafts catalysts such as the aluminum chloride ($AlCl_3$) system described in U.S. Pat. No. 3,848,012 (Cl. 260-671 R). The catalyst employed in the alkylation zone preferably comprises a fixed bed of solid material. For instance, a crystalline aluminosilicate such as described in U.S. Pat. Nos. 3,751,504; 3,751,506 and 3,755,483 may be employed. Another suitable catalyst system employs a gaseous catalyst promoter which is circulated through a bed of solid carrier particles. These carrier particles are normally inorganic oxides such as the gamma and theta forms of alumina, silica, boria and various naturally occurring inorganic oxides including clays and diatomaceous earth. The vaporous catalyst promoter is preferably a halogen-containing compound such as boron trifluoride, boron trichloride, hydrogen chloride, carbon tetrachloride, hydrogen flouride, ammonium fluoride and ammonium chloride. More preferably, the catalyst promoter is boron trifluoride. This catalyst system is further described in U.S. Pat. Nos. 3,126,421; 3,631,122 and 3,894,090.

The preferred catalyst for use in the subject process is a solid phosphoric acid (SPA) catalyst. One reason for this preference is its propensity to produce monoalkylated aromatic hydrocarbons from benzene and propylene compared to most other catalyst systems. Suitable solid phosphoric acid catalysts are available commercially. As used herein, the term "SPA catalyst" or its equivalent is intended to refer generically to a solid catalyst which contains as one of its principal raw ingredients an acid of phosphorus such as ortho-, pyro- or tetraphosphoric acid. These catalysts are normally formed by mixing the acid with a siliceous solid carrier to form a wet paste. This paste may be calcined and then crushed to yield catalyst particles, or the paste may be extruded or pelleted prior to calcining to produce more uniform catalyst particles. The carrier is preferably a naturally occurring porous silica-containing material such as kieselguhr, kaolin, infusorial earth and diatomaceous earth. A minor amount of various additives such as mineral talc, fullers earth and iron compounds including iron oxide have been added to the carrier to increase its strength and hardness. The combination of the carrier and the additives normally comprises about 15–30 wt.% of the catalyst, with the remainder being the phosphoric acid. However, the amount of phosphoric acid used in the manufacture of the catalyst may vary from about 8–80 wt.% of the catalyst as described in U.S. Pat. No. 3,402,130. The amount of the additives may be equal to about 3–20 wt.% of the total carrier material. Further details as to the composition and production of typical SPA catalysts may be obtained from U.S. Pat. Nos. 3,050,472; 3,050,473 and 3,132,109 and from other references.

The alkylation zone is maintained at benzene-alkylation promoting conditions. A general range of these conditions includes a pressure of from about 50 to 1200 psig. and a temperature of from about 60° F. to 850° F., with the preferred conditions being dependent on the catalyst system employed. With SPA catalyst, the pressure is preferably from 300 to 1000 psig. and the temperature is preferably within the range of from 300° F. to 600° F. The liquid hourly space velocity of the reactants may range from about 0.5 to 2.5. It is preferred that the reaction zone charge stream is a mixed-phase stream when an SPA catalyst is used in the reaction zone. To insure this, the feed stream should comprise light paraffins having the same number of carbon atoms per molecule as the olefin consumed in the process. The configuration of the reaction zone may be that which is customarily used with the catalyst system selected for use in the process. With SPA catalysts, upward flow through vertical beds of catalyst is preferred. It is preferred that the olefin consumed in the alkylation zone comprises propylene and/or butene when an SPA catalyst is employed.

Preferably, a stoichiometric excess of the olefinic hydrocarbon is maintained within the reaction zone. This may be accomplished by the admixture of an externally generated olefin feed stream with the benzene-containing dehexanizing zone overhead stream. The olefin to benzene ratio in the alkylation zone charge stream is preferably maintained above 1.0:1.0. As benzene may not be the only aromatic hydrocarbon present in the reaction zone charge stream, the reaction charge stream should have a minimum light olefin to total aromatic hydrocarbon ratio of 1.0:1.0. Preferably this ratio is above 1.4:1.0, and more preferably, it is above 1.5:1.0 as this is believed necessary to achieve the alkylation of 95 mole percent of the banzene present in the reaction zone feed stream. However, a very large excess of the olefin leads to the production of polyalkylated aromatics boiling above the normally accepted gasoline boiling point curve end points. The aromatic hydrocarbon to olefin ratio is therefore preferably below 2.0:1.0, and more preferably below 1.8:1.0.

The fluidized catalytic cracking zone utilized in the practice of the subject invention may itself be broken down into two basic zones, a reaction zone and a catalyst regeneration zone. The reaction zone comprises a vertical riser reactor which empties into a large volume enclosed reaction vessel containing a bed of fluidized catalyst. The feed stream to the reaction zone enters the bottom of the riser reactor and contacts finely divided particulate catalyst at a temperature of from about 800° F. to about 1050° F. at a pressure of from atmospheric to about 50 psig. The catalyst may have a diameter ranging from about 20–150 microns.

The contacting of the feed stream to the FCC unit with the catalyst under these conditions results in the cracking of a very significant number of the total molecules in the feed stream and the production of hydrocarbons having a very great range of boiling points. The reaction product vapors are passed into a separatory cyclone which separates most of the entrained catalyst from the vapors. This spent catalyst is stripped of hydrocarbon vapors and passed into the regeneration zone of the FCC unit. The catalyst is then contacted with an oxygen-containing gas at conditions which support the combustion of a controlled amount of the carbon on the surface of the catalyst. This effects the regeneration of the catalytic activity of the catalyst particles and also produces a large amount of heat, thereby heating the catalyst particles. The resultant hot regenerated catalyst is then passed through a slide valve into the riser reactor of the reaction zone. The reaction zone and the regeneration zone are operated continuously and simultaneously, with streams of catalyst flowing into and from each zone at a relatively uniform rate.

The high temperature vapor stream which is withdrawn from the reaction zone separatory cyclone is passed into a lower portion of the refluxed main column of the FCC unit. The entering vapors are cooled and separated by fractional distillation within the main column. The residual catalyst content of the reaction zone effluent stream becomes concentrated in the bottom stream of the main column which is referred to as a slurry oil. Several side-cut streams may be withdrawn from intermediate points of the main column to produce a heavy cycle gas oil, a light cycle gas oil and one or more naphtha streams. The cracking operation produces a sizable amount of light gases which include $C_1$ to $C_4$ paraffins and $C_2$ to $C_4$ olefins. These light gases and a significant quantity of heavier hydrocarbons are removed from the main column as an overhead vapor stream and passed into an overhead condenser. This produces a liquid phase and a vapor phase which are passed into the overhead receiver of the main column. A portion of the liquid phase may be returned to the column as reflux, with the remaining net liquid and the separated net vapor phase being passed into the gas concentration unit. The FCC main column is normally operated at a superatmospheric pressure below 100 psig. and with a temperature of less than 500° F. as measured at the top of the column. Further details on the operation of FCC units and their integration with main columns may be obtained by reference to U.S. Pat. Nos. 3,849,294 and 4,003,822.

The hydrotreating zone into which the light distillate is passed will contain a catalytically effective composite comprising an active component. This active component may be a metal or an oxide of a metal selected from Groups VIII or VI-B of the Periodic Table or a combination of these metals. The active component of the catalyst is deposited on or admixed with an inorganic oxide support such as silica or alumina. A preferred catalyst comprises nickel and cobalt on an alumina-silica support. The alumina is preferably present in greater proportions, with the weight ratio of alumina to silica being from about 1.5:1 to 9:1, and preferably 1.5:1 to 3:1. The catalyst used is subject to much variation and could be sulfided cobalt-molybdenum-alumina catalyst, etc. Other possible carrier materials include zirconia, titania, bauxite or bentonite. One of several commercially available catalysts may be used in this zone.

Hydrotreating is normally performed at a liquid hourly space velocity of about 1 to 5, a pressure of about 100 to 2500 psig. and a temperature of from about 300° F. to 750° F. Hydrogen is circulated through the reaction zone at a rate of about 500 to 6,000 standard cubic feet per barrel (SCFB) of feed hydrocarbons. About 200 to 1000 SCFB of hydrogen is normally consumed. The severity of the hydrotreating operation will be adjusted in accordance with the specific goal of the operation, the composition of the feed stream, activity of the catalyst, etc. Further details on hydrotreating processes may be obtained by referring to such references as U.S. Pat. Nos. 3,726,788; 3,537,982 and 2,767,121. The hydrotreating zone may contain one or more individual reactors in parallel or in series. These reactors preferably are operated with downward flow, but may be operated with radial flow or upward flow.

The reforming zone is normally operated at a temperature of from about 550° F. to about 1000° F., and preferably from 700° F. to 900° F. As used herein, the term "naphtha" is intended to refer to a mixture of hydrocarbons, including some aromatic hydrocarbons, which has a boiling point range from 90° F. to 500° F., and preferably between 100° F. and 400° F. Reforming involves the vapor phase contacting of the feed material with a catalyst containing a platinum group metal in either a fixed bed or a moving bed reactor. The type of reaction zone employed may change the ranges of preferred conditions. For instance, a typical hydrogen to hydrocarbon mole ratio is about 10:1 with a fixed bed operation, but may vary from about 0.5:1 to 20:1. With a moving bed operation, the catalyst is subject to frequent regeneration and lower hydrogen to hydrocarbon ratios of from 1:1 to 5:1 may be employed. The pressure utilized within the reforming reaction zone may vary from about 25 psig. to 1000 psig. or higher, but is preferably kept within the range of 50 psig. to about 200 psig. Generally, the liquid hourly space velocity may be from 0.5 to 10, with from 1.0 to 5.0 being a preferred range.

Reforming catalysts vary widely in their composition and in their method of manufacture but almost universally contain one or more platinum group metals in an amount of from about 0.01 to 5 wt.% of the composite, with from about 0.10 to 0.80 wt.% being preferred. The preferred metal is platinum, but palladium, rhodium, ruthenium, etc. may also be employed. This metal is carried on an inorganic oxide support, which is preferably alumina spheres having a diameter of from about 1/16-inch to about ¼-inch. The catalyst will preferably also contain a combined halogen such as chlorine, fluorine or iodine to impart an acid-acting character to the catalyst. This component is suitably present in the range of from 0.5 to about 1.5 wt.% of the composite when measured as the elemental halogen. The catalyst can also contain a promoter component. Typical promoters are rhenium, germanium, tin, and lead. If used, this component is preferably present in an amount of from 0.1 to about 3.0 wt.% of the catalyst when measured as the elemental metal. The subject invention is not centered on the composition of the catalyst used and suitable catalysts are available commercially. Further details of the reforming of hydrocarbons may be obtained by reference to U.S. Pat. Nos. 3,647,680; 3,821,104; 3,650,944; 3,830,727 and 3,647,679.

We claim as our invention:

1. A process for the production of gasoline with a reduced benzene content which comprises the steps of:

(a) passing a first gasoline precursor stream comprising a mixture of above 25 mole percent aromatics and $C_4$ to $C_9$ paraffinic hydrocarbon, said mixture having a boiling point range between 90° F. and 410° F., into a first fractionation zone operated at fractionation conditions effective to produce a net overhead stream comprising benzene and a net bottoms stream comprising $C_9$ hydrocarbons;

(b) passing a second gasoline precursor stream into a second fractionation zone operated at fractionation conditions effective to produce a net overhead stream comprising $C_3$ and $C_4$ olefins, $C_3$ and $C_4$ paraffins and benzene and a net bottoms stream comprising $C_9$ hydrocarbons;

(c) passing the net overhead stream of the first fractionation zone and the net overhead stream of the second fractionation zone into an alkylation zone, wherein the ratio of olefin to aromatic hydrocarbons is above 1.0:1.0 in the combination of the net overhead streams passed to said alkylation zone which is maintained at alkylation-promoting conditions and effecting the alkylation of said benzene with said olefin and the production of an alkylation zone effluent stream comprising $C_9$ and $C_{10}$ alkylaromatic hydrocarbons and $C_3$ and $C_4$ paraffins;

(d) passing the alkylation zone effluent stream into a third fractionation zone operated at conditions effective to produce a net overhead stream comprising $C_4$ paraffins and a net bottoms stream comprising $C_{10}$ alkylaromatic hydrocarbons; and, (e) combining at least a portion of the net bottoms stream of the third fractionation zone with at least a portion of the net bottoms stream of the first fractionation zone and thereby forming a gasoline boiling range product stream of reduced benzene content.

2. The process of claim 1 further characterized in that the alkylation zone contains a bed of solid phosphoric acid catalyst.

3. A process for the production of gasoline of reduced benzene content which comprises the step of:

(a) passing a first hydrocarbon naphtha distillate stream comprising a mixture of aromatic and $C_4$ to $C_9$ paraffinic hydrocarbons into a catalytic reforming zone operated at reforming conditions and effecting the production of a reforming zone effluent stream comprising benzene and $C_9$ hydrocarbons;

(b) passing the reforming zone effluent stream into a first fractionation zone operated at conditions effective to produce a net overhead stream comprising benzene and a net bottoms stream comprising $C_9$ hydrocarbons;

(c) passing a second hydrocarbon distillate stream into a fluidized catalytic cracking zone which comprises a reaction zone and main fractionation column and effecting the production of a main column net overhead vapor stream which is passed into a gas concentration unit comprising an adsorber and a second fractionation zone;

(d) removing a net bottoms stream comprising $C_3$ olefins, $C_3$ paraffins, benzene and $C_7$ to $C_9$ hydrocarbons from the second fractionation zone;

(e) passing the net bottoms stream of the second fractionation zone into the first fractionation zone;

(f) passing the net overhead stream of the first fractionation zone into an alkylation zone wherein the ratio of olefins to aromatic hydrocarbons is above 1.0:1.0 and wherein said zone is maintained at alkylation-promoting conditions and effecting the alkylation of benzene and the production of an alkylation zone effluent stream comprising $C_9$ alkylaromatic hydrocarbons and $C_3$ paraffins;

(g) passing the alkylation zone effluent stream into a third fractionation zone operated at conditions effective to produce a net overhead stream comprising $C_3$ paraffins and a net bottoms stream comprising $C_9$ alkylaromatic hydrocarbons; and, (h) combining the net bottoms stream of the third fractionation zone with at least a portion of the net bottoms stream of the first fractionation zone to form a gasoline product stream of reduced benzene content.

4. The process of claim 3 further characterized in that a portion of the net bottoms stream of the first fractionation zone is passed into the absorber of the gas concentration unit as a lean oil stream.

5. The process of claim 4 further characterized in that the alkylation zone contains a bed of solid phosphoric acid catalyst.

6. A process for the production of gasoline of reduced benzene content which comprises the steps of:

(a) fractionating a feed stream comprising paraffinic hydrocarbons and above 25 mole percent aromatic hydrocarbons into a light first hydrocarbon distillate stream which comprises $C_8$ hydrocarbons and a heavier second hydrocarbon distillate stream;

(b) hydrotreating the first hydrocarbon distillate stream;

(c) passing the first hydrocarbon distillate stream into a catalytic reforming zone operated at reforming conditions and effecting the production of a liquid phase reforming zone effluent stream comprising benzene and $C_7$ to $C_9$ hydrocarbons;

(d) passing the reforming zone effluent stream into a first fractionation column operated at conditions effective to produce a net overhead stream comprising benzene and a net bottoms stream comprising $C_7$ to $C_9$ hydrocarbons;

(e) passing the second hydrocarbon distillate stream into a fluidized catalytic cracking zone which comprises a reaction zone and a main fractionation column and effecting the production of a main column net overhead vapor stream and a main column net overhead liquid stream which are passed into a gas concentration unit comprising an absorber and a second fractionation column;

(f) removing a net bottoms stream comprising $C_3$ olefins, $C_3$ paraffins, benzene and $C_7$ to $C_9$ hydrocarbons from the second fractionation column;

(g) passing the net bottoms stream of the second fractionation column into the first fractionation column;

(h) passing a first portion of the net bottoms stream of the first fractionation column into the absorber of the gas concentration unit as a lean oil stream;

(i) passing the net overhead stream of the first fractionation column containing paraffins, olefins and benzene wherein the molar ratio of olefine to benzene of above 1.0 mol of olefin per mol of benzene into an alkylation zone maintained at alkylation-promoting conditions and effecting the alkylation of benzene and the production of an alkylation zone effluent stream comprising $C_9$ alkylaromatic hydrocarbons and $C_3$ paraffins;

(j) passing the alkylation zone effluent stream into a third fractionation column operated at conditions effective to produce a net overhead stream comprising $C_3$ parafins and a net bottoms stream comprising $C_9$ alkylaromatic hydrocarbons; and, (k) combining the net bottoms stream of the third fractionation column with a second portion of the net bottoms stream of the first fractionation column and thereby forming a gasoline boiling range product stream of reduced benzene content.

7. The process of claim 6 further characterized in that the alkylation zone comprises a bed of solid phosphoric acid catalyst.

8. The process of claim 6 further characterized in that the second hydrocarbon distillate is produced in a fractionation column operated at a subatmospheric pressure.

* * * * *